US009512849B2

(12) United States Patent
Naβ et al.

(10) Patent No.: US 9,512,849 B2
(45) Date of Patent: Dec. 6, 2016

(54) MULTI-STAGE INTEGRALLY GEARED COMPRESSOR

(75) Inventors: Dieter Naβ, Moers (DE); Lars Schlüter, Moers (DE)

(73) Assignee: SIEMENS AKTIENGESELLSCHAFT, München (DE)

( * ) Notice: Subject to any disclaimer, the term of this patent is extended or adjusted under 35 U.S.C. 154(b) by 898 days.

(21) Appl. No.: 13/697,084

(22) PCT Filed: May 10, 2011

(86) PCT No.: PCT/EP2011/057456

§ 371 (c)(1),
(2), (4) Date: Nov. 9, 2012

(87) PCT Pub. No.: WO2011/141439

PCT Pub. Date: Nov. 17, 2011

(65) Prior Publication Data

US 2013/0058761 A1 Mar. 7, 2013

(30) Foreign Application Priority Data

May 11, 2010 (DE) ..... 10 2010 020 145

(51) Int. Cl.
*F04D 25/16* (2006.01)
*F04D 25/02* (2006.01)

(52) U.S. Cl.
CPC ..... *F04D 25/02* (2013.01); *F04D 25/028* (2013.01); *F04D 25/163* (2013.01)

(58) Field of Classification Search
CPC ..... F04D 25/02; F04D 25/028; F04D 25/163
USPC ..... 415/122.1
See application file for complete search history.

(56) References Cited

U.S. PATENT DOCUMENTS

| | | | | |
|---|---|---|---|---|
| 3,038,307 | A * | 6/1962 | Oprecht | F01D 1/26 415/122.1 |
| 4,010,016 | A * | 3/1977 | Haugen | F04D 25/163 415/169.2 |
| 4,047,848 | A | 9/1977 | Poole | |
| 4,105,372 | A * | 8/1978 | Mishina | F01D 15/12 415/122.1 |
| 4,219,306 | A * | 8/1980 | Fujino | F04D 25/163 415/62 |
| 6,398,517 | B1 * | 6/2002 | Choi | F04D 25/16 417/243 |
| 7,703,283 | B2 * | 4/2010 | Barker | F01P 7/046 290/4 C |
| 2003/0123972 | A1 * | 7/2003 | Quetel | F04D 25/163 415/1 |

(Continued)

FOREIGN PATENT DOCUMENTS

| | | |
|---|---|---|
| DE | 2503174 A1 | 8/1975 |
| DE | 2451741 A1 | 5/1976 |

(Continued)

*Primary Examiner* — Ninh H Nguyen
*Assistant Examiner* — Aaron R Eastman

(57) ABSTRACT

A multi-stage integrally geared compressor includes a first process stage, a second process stage and a gearbox for coupling the two process stages to each other at different rotational speeds. The gearbox further couples a compressor drive shaft to the two process stages at a further rotational speed, which is different from the rotational speeds of the process stages.

11 Claims, 3 Drawing Sheets

(56) References Cited

U.S. PATENT DOCUMENTS

| | | | | |
|---|---|---|---|---|
| 2003/0215339 | A1* | 11/2003 | Grimmer | F04B 25/00 417/201 |
| 2007/0134111 | A1* | 6/2007 | Eybergen | F04D 13/028 417/423.6 |
| 2007/0204615 | A1* | 9/2007 | Vrbas | F01D 17/162 60/602 |
| 2015/0086394 | A1* | 3/2015 | Taguchi | F04D 25/06 417/366 |

FOREIGN PATENT DOCUMENTS

| | | | |
|---|---|---|---|
| DE | 2603359 | A1 | 8/1976 |
| EP | 0653566 | A1 | 5/1995 |
| GB | 2263308 | A | 7/1993 |
| RU | 2268399 | C2 | 1/2006 |
| SU | 821750 | A1 | 4/1981 |

* cited by examiner

MULTI-STAGE INTEGRALLY GEARED COMPRESSOR

CROSS REFERENCE TO RELATED APPLICATIONS

This application is the US National Stage of International Application No. PCT/EP2011/057456 filed May 10, 2011, and claims the benefit thereof. The International Application claims the benefits of German Patent Application No. 10 2010 020 145.6 DE filed May 11, 2010. All of the applications are incorporated by reference herein in their entirety.

FIELD OF INVENTION

The invention relates to a multi-stage integrally geared compressor having a first process stage, a second process stage and a gear, by means of which the two process stages are coupled to each other with different rotational speeds, wherein the gear couples a compressor drive shaft to the two process stages with a third rotational speed, which is different from the rotational speeds of the process stages.

BACKGROUND OF INVENTION

Integrally geared compressors are used to compress air or chemical gases, for air separation, in metallurgy and in other processes. The air or other gases, which are likewise referred to as air below for the sake of simplicity, is compressed to a first pressure in the first process stage and then fed to the second process stage, where it is compressed to a second, higher pressure.

Large integrally geared compressors, e.g. those for modern air separation plants for the production of several thousand tonnes of oxygen per day, must compress high volume flows with a high efficiency. To achieve a high efficiency, the process stages effecting the air compression are operated at different rotational speeds, wherein the second process stage is generally operated at a higher rotational speed than the first process stage.

To produce the different rotational speed with a single compressor drive, the integrally geared compressor is equipped with a gear, which couples the two process stages to each other with different rotational speeds. The drive can be either an electric motor or a turbomachine, e.g. a steam turbine or a gas turbine.

A device of the type in question is already known from the following documents: US 2007/134111 A1, U.S. Pat. No. 4,105,372 A, EP 0 653 566 A1, U.S. Pat. No. 4,047,848 A.

SUMMARY OF INVENTION

It is an object to specify a multi-stage integrally geared compressor which can be operated with a low outlay and a high efficiency.

This object is achieved by a multi-stage integrally geared compressor as claimed in the claims.

The invention starts from the consideration that, for air compression, a process stage rotational speed of well above 1,000 rpm is required in order to be able to compress a very large air volume with a high efficiency. If an electric motor is used as a compressor drive, then—to enable it to be coupled directly in a rigid manner to one of the two impellers—it must be a very high speed electric motor which, for example, has a frequency converter. An electric motor of this kind is costly.

In order to be able to use a standard electric motor, it is therefore advantageous if the gear converts the rotational speed of the compressor drive, i.e. that of the compressor drive shaft, to a rotational speed suitable for one process stage, in particular for that of the first process stage. This makes it possible to convert a relatively low rotational speed of the compressor drive to a higher, second rotational speed of the first process stage and to an even higher, third rotational speed of the second process stage. Both the compressor drive and the two process stages can be operated at what is an optimum rotational speed for each one, thus enabling the integrally geared compressor to be operated by means of a simple drive, e.g. a simple electric motor, with a high efficiency.

The integrally geared compressor can be an air compressor or a process gas compressor, wherein gases of any kind are also referred to below as air for the sake of simplicity. It is expedient if the integrally geared compressor is a turbocompressor. The compressor drive shaft, also referred to as a connecting shaft, is used for connection to a compressor drive, i.e. to transmit the full driving power input into the integrally geared compressor by the compressor drive.

One process stage can be a radial compressor stage having one impeller, constructed as an overhung stage for example, as is conventional with integrally geared compressors, or a plurality of impellers arranged in series on a shaft between two shaft bearings. One process stage can also be an axial compressor stage, which comprises one or more rows of axial blading rotating on a shaft.

To simplify the terminology, both an impeller of a radial compressor stage and a rotating row of blading in an axial compressor stage are referred to below as a blade wheel. Each of the two process stages is equipped with at least one blade wheel. The rotational speed of a process stage is the rotational speed of the at least one blade wheel thereof. By means of the gear, the blade wheels of the two process stages are coupled to each other with different rotational speeds.

A process stage is characterized by an inlet, e.g. an inlet stub, and an outlet, e.g. an outlet stub. It can comprise one or more blade wheels, wherein two radial impellers on a common shaft can also foam two process stages if they each have their own inlets and outlets. A process stage can effect one work step or one work stage in a work process, e.g. air compression. Two process stages can perform two work steps in succession in a single work process or two work steps in two separate work processes. The two process stages can compress the same air in succession to different pressures.

For this purpose, it is expedient if the two process stages are made different in shape and/or size. It is advantageous if the process stages and the gear are arranged in a single compressor housing and enclosed by the latter.

It is expedient if the compressor housing comprises a plurality of pressure chambers which are sealed off from one another, wherein the first process stage, the second process stage and the gear can be delimited with respect to each other in a pressure tight manner.

In an advantageous embodiment of the invention, the gear comprises a planetary gear. With the aid of a planetary gear, high forces combined with high rotational speeds can be transmitted in a stable manner that is reliable over the long term.

A particularly effective arrangement of the planetary gear in the overall gear can be achieved if the sun wheel is arranged centrally in the gear, that is to say, in particular, centrosymmetrically with respect to the drive shafts of the two process stages.

Arrangement of the sun wheel axis in alignment with the shaft of the first process stage is particularly advantageous.

It is furthermore proposed that the compressor drive shaft should be coupled to the two process stages by the planetary gear. The driving energy of both process stages can be routed via a single planetary gear, thereby ensuring that said gear is used efficiently. It is expedient if the compressor drive shaft is aligned in a manner centered with respect to the planetary gear, wherein an arrangement of the compressor drive shaft in alignment with the axis of the sun wheel is advantageous.

It is advantageous if the sun wheel is held fixed relative to the housing, i.e. fixed relative to the gear housing, to the housing of the integrally geared compressor, to the housing of a drive, that is to say, for example, a motor housing, or fixed relative to some other element that is stationary with respect to the housing of the integrally geared compressor.

If the compressor drive shaft is rigidly connected to a planet holder of the planetary gear, efficient transmission from the drive via the planetary gear to the process stages can be achieved.

Another advantageous embodiment of the invention envisages that the first process stage is rigidly connected to an annulus of the planetary gear. By means of this symmetrical arrangement of the first process stage relative to the planetary gear, stable transmission of high forces to the process stage, i.e. to the blade wheel or blade wheels thereof, can be achieved.

By means of the planetary gear, a rotational speed of the compressor drive shaft is expediently converted to a different, in particular higher, rotational speed of the first process stage. In this case, these two rotational speeds are expediently applied to the planet carrier and to the annulus of the planetary gear.

To produce the third rotational speed for the second process stage, it is advantageous if the gear comprises a spur wheel gear in addition to the planetary gear. One advantageous embodiment envisages that the shaft of the second process stage is expediently the pinion shaft of a pinion of the spur wheel gear. Simple and effective power transmission can be achieved through rolling contact between the pinion shaft or the pinion and the annulus of the planetary gear.

An effective connection between the planetary gear and the spur wheel gear can be achieved if the annulus of the planetary gear is rigidly connected to spur wheel toothing of the spur wheel gear. In this case, it is expedient if the large wheel of the spur wheel gear is formed by the planetary gear or annulus of the planetary gear.

In terms of construction and power transmission, it is furthermore advantageous if the gear contains a spur wheel gear having a large wheel, wherein the first process stage is arranged symmetrically with respect to the large wheel. This furthermore provides the possibility of embodying the first process stage as a central axial compressor stage.

To compress particularly high air flows, especially in a range above 500,000 $m^3/h$, the use of an axial compressor stage as the first process stage is advantageous. Air can be drawn in through a large volume axial inlet and compressed effectively in large volumes. An arrangement of the integrally geared compressor which is capable of bearing particularly high mechanical loads and is compact can be achieved if the first process stage, that is to say, for example, the blading of the first process stage embodied as an axial compressor stage, is rigidly coupled to the large wheel.

If the second process stage is a radial compressor stage, effective compression to a high ultimate pressure can be achieved.

For the compression of a high volume flow in the second process stage to a high pressure, intercooling is advantageous. For this purpose, the volume flow emerging from the first process stage can be fed to an intercooler arranged in the air flow path between the two process stages. For effective compression of air, air compressed in the first process stage can thus undergo intercooling before it enters the second process stage and is compressed to the ultimate pressure thereof. For this purpose, it is expedient if the integrally geared compressor comprises an air outlet from the integrally geared compressor from the first process stage and an air inlet into the integrally geared compressor to the second process stage, thus allowing a cooler to be connected to the air inlet and to the air outlet. The air compressed in the first process stage is passed through the cooler for recooling and, after recooling, enters the second process stage. It is also possible to arrange the cooler within the compressor housing. Especially if the first process stage is an axial compressor stage, it is advantageous if the volume flow compressed by the latter can be distributed between a plurality of second process stages, the processing volume of which is smaller. In this arrangement, a plurality of radial compressor stages can be employed in parallel as second process stages. For this purpose, it is advantageous if the volume flow emerging from the first process stage, which is already precompressed, is divided into a plurality of volume flows for further compression in a plurality of second process stages.

The integrally geared compressor thus advantageously comprises a plurality of second process stages employed in parallel, each having separate drive shafts. It is expedient if each of the second process stages is a radial compressor stage having an impeller of overhung construction. The second process stages can be distributed symmetrically around a center of the gear, thus ensuring symmetrical and hence robust distribution of forces in the gear.

The two process stages can be embodied in such a way that the intake side of the second process stage is connected to the discharge side of the first process stage. This enables air to be precompressed in a first process step and further compressed in a subsequent process step. As an alternative, it is conceivable for both of the process stages to operate in different work processes, the first process stage being supplied with different air from the second process stage. In this way, different gases and/or different volumes can be processed by means of the integrally geared compressor in the two process stages.

BRIEF DESCRIPTION OF THE DRAWINGS

The invention is explained in greater detail with reference to an illustrative embodiment, which is shown in the drawings.

In the drawing.

DETAILED DESCRIPTION OF INVENTION

Figure 1:
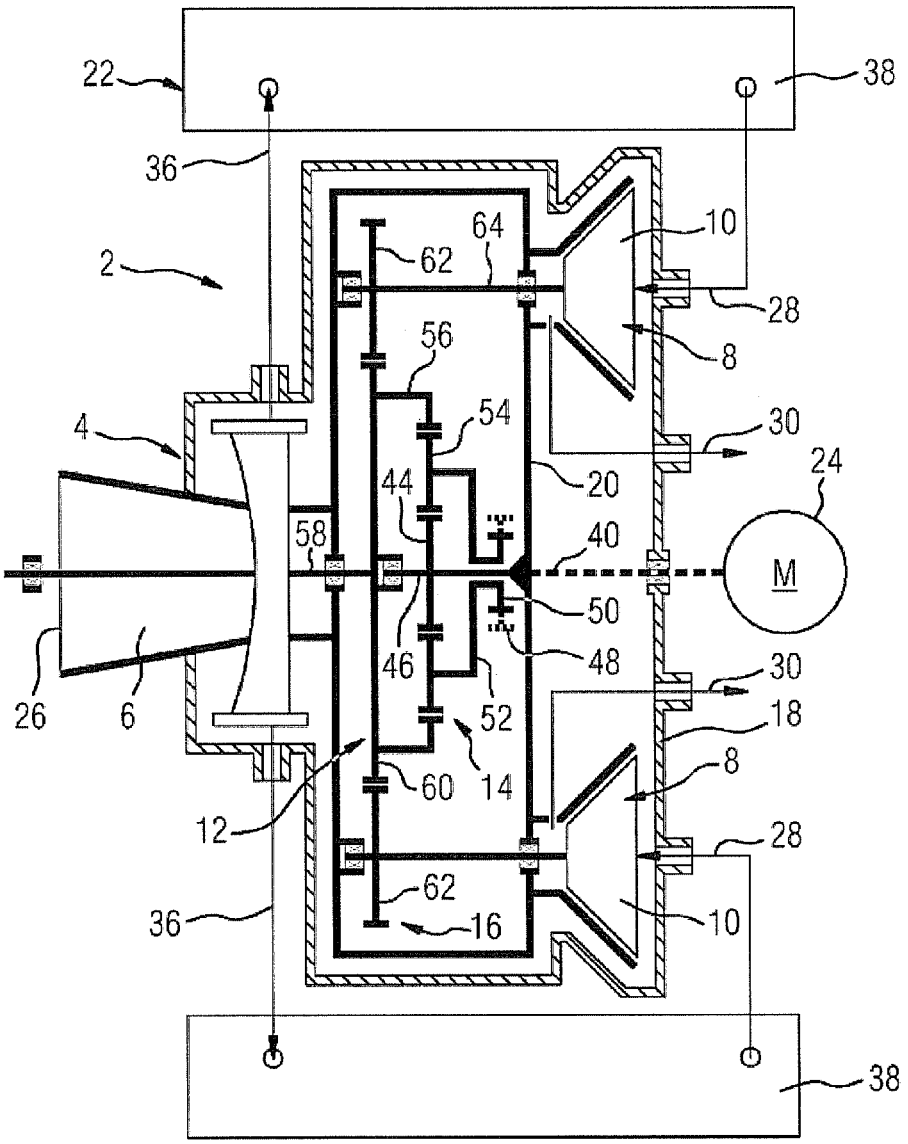
FIG. 1 shows a schematic representation of an integrally geared compressor having an axial compressor component and a radial compressor component as well as a cooler.

FIG. 1 shows an integrally geared compressor 2 in a sectioned schematic representation. The integrally geared compressor 2 comprises a first process stage 4 in the form of an axial compressor stage or axial compressor having axial blading 6, which is indicated only schematically and which can be of single row or multiple row design, i.e. can comprise one or more blade wheels mounted on a common shaft and connected rigidly to each other. The integrally geared compressor 2 furthermore has two second process stages 8, each in the foam of a radial compressor stage or radial compressor, each having a radial impeller 10, which is indicated only schematically.

The three process stages 4, 8 are connected to each other by means of a gear 12, which comprises a planetary gear 14 and a spur wheel gear 16. Both process stages 4, 8 and the gear 12 are arranged in a compressor housing 18, which encloses said elements. The gear 12 is arranged in a gear housing 20 within the compressor housing 18. The compressor housing 18 is divided into a plurality of chambers, which are delimited with respect to each other in a pressure tight manner, wherein the first process stage 4 and both second process stages 8 are separated from each other in a pressure tight manner. The gear 12 is likewise separated in a pressure tight manner in the gear housing 20 thereof from the process stages 4, 8, thus ensuring that no compressed or uncompressed process gas enters the gear housing 20. It is likewise possible for the gear housing 20 to be situated at least somewhat toward the outside and thus to form part of the compressor housing 18.

A cooler 22 is positioned outside the compressor housing 18, although it is equally possible to accommodate the cooler 22 within the compressor housing 18. Likewise arranged outside the compressor housing 18 is a drive 24 for driving the integrally geared compressor 2, which can be an electric motor, a steam turbine, a gas turbine or some other suitable drive 24.

The integrally geared compressor serves to compress air, which is drawn in through the inlet 26 of the first process stage 4, is compressed to a first pressure of, for example, 3.96 bar by the axial blading 6 and is fed to the cooler 22. In this illustrative embodiment, the compressed volume flow is 800,000 $m^3$/h, for example. The air heated by compression is cooled down in the cooler 22 and leaves the cooler 22 at a pressure of 3.87 bar, for example, and is fed to the two radial impellers 10 of the second process stage 8, as indicated by arrows 28. By means of the second process stage 8, the two air flows are each further compressed to 8.67 bar and leave the integrally geared compressor 2 through appropriate outlets 30. The volumes and pressures can be adapted to an extremely wide variety of different requirements and within a wide range by means of appropriate structural dimensions and rotational speeds.

Figure 2:
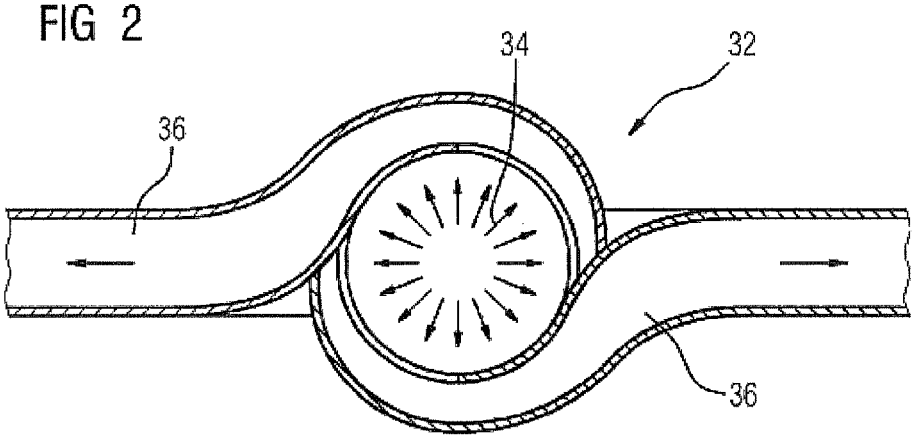
FIG. 2 shows a schematic representation of an air duct from the axial compressor component to the radial compressor component.

The division of the air precompressed in the first process stage 4 between two air flows into the two second process stages 8 is illustrated schematically in FIG. 2. The air compressed by the axial blading 6 is forced radially outward into an air distribution system 32, as indicated by arrows 34. In this process, the precompressed air is distributed equally between two flow ducts 36, which each carry the air to a cooling element 38 of the cooler 22. In this way, the precompressed air from the single stage axial compressor is distributed equally between the two radial compressors of the two second process stages.

To drive the two process stages 4, 8, the compressor drive 24 is connected to the planetary gear 14 indirectly (FIG. 1) or directly (FIG. 3) by means of a compressor drive shaft 40. In both illustrations, the integrally geared compressor 2, 42 is shown from above, and the two cooling elements 38 are in each case at the side or below the gear 12.

In the illustrative embodiment shown in FIG. 1, the sun wheel 44 is held fixed relative to the housing. It is connected securely to the gear housing 18 by means of a sun wheel axle 46. The gear 12 is driven by means of the compressor drive shaft 40, which is illustrated in dashed lines in FIG. 1 and which is rigidly connected to a gearwheel 48, likewise represented in dashed lines, below the sun wheel axle 46. Gearwheel 48 meshes with a gearwheel 50 situated above it, the latter gearwheel being rigidly connected to the planet carrier 52 of the planetary gear 14. The two gearwheels 48, 50 form a further spur wheel gear, the gear ratio of which can be adapted to the integrally geared compressor 2, depending on requirements.

The drive 24 drives the compressor drive shaft 40 at a rotational speed of 1,000 rpm, for example. This rotational speed is stepped up to 1,500 rpm of gearwheel 50 and hence of the planet carrier 52. With its planet wheels 54 and by means of the sun wheel 44, which is held fixed relative to the housing, the planet carrier 52 drives an annulus 56, which rotates at a speed of 3,400 rpm. The annulus 56 is connected by an axial wheel shaft 58 to the axial blading 6 and drives this at a rotational speed of 3,400 rpm. The annulus 56 replaces or forms the large wheel 60 of the spur wheel gear 16, wherein the annulus 56 can be provided with internal toothing for the planet wheels 54 and with external toothing for spur wheels 62 of the spur wheel gear 16. In another embodiment, the annulus 56 is mounted on a flange which forms the large wheel 60 for the spur wheel gear 16. The large wheel 60 and the flange rotate at the same speed as the annulus 56. By means of the spur wheel gear 16, the two spur wheels 62 are driven at a rotational speed of 9,400 rpm. Through the rigid coupling of the spur wheels 62 to the pinion shafts 64 of the radial impellers 10, to which they are rigidly coupled, the speed of 9,400 rpm is transmitted to the radial impellers 10. By virtue of this high rotational speed, compression of the air to the ultimate pressure takes place in a manner which is optimized in terms of power.

In another embodiment, one or more third process stages in addition to the two second process stages 8 are conceivable. Each third process stage is driven by means of a pinion or spur wheel, which meshes with the large wheel 60 similarly to the spur wheels 62. The additional spur wheels can have a different number of teeth from the spur wheels 62, thus allowing the third process stage or the third process stages to be driven at a different rotational speed from the second process stage or the second process stages. In this way, it is possible to achieve three process stages, which are each driven at a specific rotational speed, with each of the three rotational speeds being different to the other two.

Figure 3:
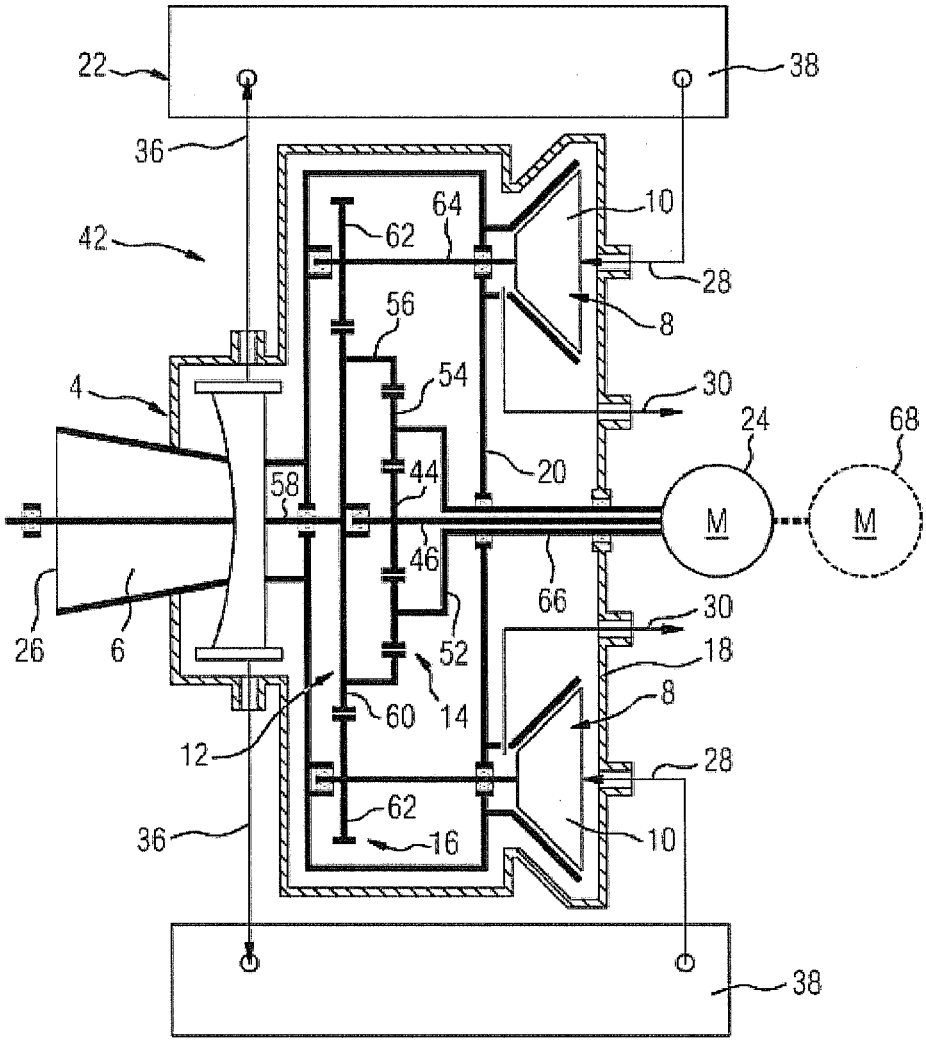
FIG. 3 shows a schematic representation of an alternative integrally geared compressor with coaxial routing of the compressor drive shaft and a sun wheel holder.

In the illustrative embodiment shown in FIG. 3, the sun wheel axle 46 is passed to the outside through the gear housing 18. It can be passed through the drive 24 and connected to a stationary element, ensuring that it is held fixed relative to the housing. In this arrangement, the compressor drive shaft 66 is embodied as a hollow shaft and extends coaxially around the sun wheel axle 46. It transmits the driving speed of the drive and directly to the planet carrier 52.

Another embodiment envisages that the sun wheel axle 46 is employed as a sun wheel shaft which is connected to the drive 24. It can be driven in addition to the planet carrier 52, wherein the rotational speed of the sun wheel axle 46 is different from the rotational speed of the compressor drive shaft 66 if the intention is to achieve a step up in the rotational speed transmitted to the annulus 56. If the rotational speed is the same, the annulus 56 is also operated at this rotational speed. Through rotation of the sun wheel axle 46 and the compressor drive shaft 66 in opposite directions, the step up to the annulus 56 can be increased even further. In addition, the torque between the drive 24 and the integrally geared compressor 42 can be reduced and, in extreme cases, can even be brought close to zero.

It is also conceivable and advantageous to divide the drive 24 into two drive parts, situated one behind the other for example, as indicated by the drive part 68 illustrated in addition and in dashed lines. One drive part 68 is provided to rotate the sun wheel axle 46 and the other drive part—in this case, the drive 24 drawn in solid lines forms the other drive part—is provided to rotate the compressor drive shaft 66 and hence the planet carrier 52. Both drive parts 68 are expediently set up for rotation in opposite directions, and it is therefore possible to achieve a high speed increase therewith, with two times half the driving power in comparison with the single drive 24.

By virtue of the design of the connection between the planetary gear 14 and the spur wheel gear 16, the arrangement of the compressor drive shaft 66 and the axial wheel shaft 58 in alignment with one another, which is advantageous for the integrally geared compressor 2, is possible, i.e. a coaxial arrangement which gives rise to a compact and high performance mechanism. Moreover, the two shafts 58, 66 are arranged centrosymmetrically in the integrally geared compressor 2. Moreover, the two radial impellers 10 are arranged centrosymmetrically around the two shafts 58, 66. More than two radial impellers 10, which are expediently likewise arranged centrosymmetrically around the two shafts 58, 66, are likewise possible.

In another illustrative embodiment, the two spur wheels 62 of the integrally geared compressor 2, 42 can have a different number of teeth, thus enabling the two radial impellers 10 to be operated at different rotational speeds. As a result, the two partial air flows can be compressed to a different terminal pressure. By means of an asymmetric configuration of the two flow ducts 36, the air flow can be distributed unequally between the radial impellers 10, thus producing a smaller flow to a faster rotating radial impeller 10 for higher compression, for example.

The invention claimed is:

1. A multi-stage integrally geared compressor, comprising:
- a first process stage,
- a second process stage,
- a compressor drive shaft and
- a gear which couples the two process stages to each other with different rotational speeds,
- wherein the gear couples the compressor drive shaft to the first and second process stages with a further rotational speed, which is different from the different rotational speeds of the process stages,
- wherein the first process stage is an axial compressor stage and the second process stage is a radial compressor stage, and
- wherein the gear is arranged in a gear housing within the compressor housing.

2. The integrally geared compressor as claimed in claim 1, wherein the compressor drive shaft is coupled to the process stages by a planetary gear.

3. The integrally geared compressor as claimed in claim 2, wherein the compressor drive shaft is aligned in a manner centered with respect to the planetary gear.

4. The integrally geared compressor as claimed in claim 2, wherein the compressor drive shaft is rigidly connected to a planet carrier of the planetary gear.

5. The integrally geared compressor as claimed in claim 1, wherein a plurality of second process stages are provided which are arranged in parallel, each second process stage having a separate drive shaft.

6. The integrally geared compressor as claimed in claim 1, wherein an intake side of the second process stage is connected to a discharge side of the first process stage.

7. A multi-stage integrally geared compressor, comprising:
- a first process stage,
- a second process stage,
- a compressor drive shaft and
- a gear which couples the two process stages to each other with different rotational speeds,
- wherein the gear couples the compressor drive shaft to the first and second process stages with a further rotational speed, which is different from the different rotational speeds of the process stages,
- wherein the first process stage is an axial compressor stage and the second process stage is a radial compressor stage,
- wherein the compressor drive shaft is coupled to the process stages by a planetary gear, and
- wherein the first process stage is rigidly connected to an annulus of the planetary gear.

8. The integrally geared compressor as claimed in claim 7, wherein the annulus of the planetary gear is rigidly connected to spur wheel toothing of a spur wheel gear of the gear.

9. The integrally geared compressor as claimed in claim 8, wherein the second process stage is rigidly connected to a pinion shaft of the spur wheel gear.

10. A multi-stage integrally geared compressor, comprising:
- a first process stage,
- a second process stage,
- a compressor drive shaft and
- a gear which couples the two process stages to each other with different rotational speeds,
- wherein the gear couples the compressor drive shaft to the first and second process stages with a further rotational speed, which is different from the different rotational speeds of the process stages,
- wherein the first process stage is an axial compressor stage and the second process stage is a radial compressor stage, and
- wherein the gear contains a spur wheel gear having a large wheel, wherein the first process stage is arranged symmetrically with respect to the large wheel.

11. The integrally geared compressor as claimed in claim 10, wherein the first process stage is rigidly coupled to the large wheel.

* * * * *